US006115986A

United States Patent [19]

Kelly

[11] Patent Number: 6,115,986

[45] Date of Patent: Sep. 12, 2000

[54] STACKABLE BOX STUD

[75] Inventor: Michael Herbert Kelly, West Pennant Hills, Australia

[73] Assignee: BHP Steel (JLA) Pty Ltd, Melbourne, Australia

[21] Appl. No.: 09/242,982

[22] PCT Filed: Aug. 29, 1997

[86] PCT No.: PCT/AU97/00556

§ 371 Date: Jun. 23, 1999

§ 102(e) Date: Jun. 23, 1999

[87] PCT Pub. No.: WO98/09035

PCT Pub. Date: Mar. 5, 1998

[30] Foreign Application Priority Data

Aug. 30, 1996 [AU] Australia ..... P02001

[51] Int. Cl.[7] ..... E04C 3/30

[52] U.S. Cl. ..... 52/731.9; 52/729.5; 52/730.6; 52/729.1; 52/731.7; 52/720.1; 52/634

[58] Field of Search ..... 52/731.9, 729.5, 52/730.6, 579, 588.1, 729.1, 731.7, 720.1, 731.1, 634, 731.5, 732.3, 733.2, 592.6

[56] References Cited

U.S. PATENT DOCUMENTS

| | | | |
|---|---|---|---|
| 991,603 | 5/1911 | Brooks | 52/364 |
| 1,407,242 | 2/1922 | Wylie | 52/731.6 |
| 1,421,618 | 7/1922 | Thurston | 52/729.3 |
| 2,065,378 | 12/1936 | Kling | 52/729.5 |
| 2,508,032 | 5/1950 | Kennedy | 52/731.7 |
| 3,256,670 | 6/1966 | Tersigni | 52/634 |
| 3,342,007 | 9/1967 | Merson | 52/729.5 |
| 3,385,015 | 5/1968 | Hadley | 52/223.8 |
| 3,609,933 | 10/1971 | Jahn et al. | 52/461 |
| 4,364,212 | 12/1982 | Pearson et al. | 52/281 |
| 4,409,771 | 10/1983 | Lowe | 52/729.3 |
| 4,435,936 | 3/1984 | Rutkowski | 52/481.1 |
| 5,373,679 | 12/1994 | Goleby | 52/729.5 |
| 5,403,986 | 4/1995 | Goleby | 219/61.2 |
| 5,501,053 | 3/1996 | Goleby | 52/729.5 |
| 5,535,569 | 7/1996 | Seccombe et al. | 52/634 |
| 5,842,318 | 12/1998 | Bass et al. | 52/653.1 |

FOREIGN PATENT DOCUMENTS

| | | |
|---|---|---|
| 1326340 | of 0000 | Canada . |
| 866234 | of 0000 | United Kingdom . |
| 9001091 | of 0000 | WIPO . |

*Primary Examiner*—Christopher T. Kent
*Assistant Examiner*—Jennifer I. Thissell
*Attorney, Agent, or Firm*—Baker Botts L.L.P.

[57] ABSTRACT

A structural member of the kind including a strip of metal sheet folded over onto itself at its lateral edges so that the member has respective boxed edge formations (20, 21) which extend between a pair of notional substantially parallel planes and are linked by a web (30). At least one of the boxed edge formations defines a longitudinally extending ridge (40) at one of the planes and, behind the other plane; an outwardly open longitudinally extending groove (34) complementary to the ridge, whereby the structural member may be stacked on another similar member and the stack be laterally stabilized by co-operation of the groove (34) on one member and the ridge (40) on the other.

10 Claims, 3 Drawing Sheets

STACKABLE BOX STUD

FIELD OF THE INVENTION

This invention relates generally to structural members for use as components in metal building frames and is of particular though not exclusive relevance to structural members of the kind formed from a strip of metal and used as e.g. wall studs, floor joists, ceiling joists and other lightweight beams.

BACKGROUND ART

The present applicant's Australian Patent 667145 discloses a structural member of a kind rollformed from a strip of metal sheet so that the strip is folded over onto itself at its lateral edges to form respective boxed edge formations linked by a web. The web and adjacent portions of the boxed edge formations define a longitudinally extending recess of dovetail cross-section. Boxed structural members of this form are well suited to serve as wall studs in steel building frames in that they provide sufficient structural strength with minimum material, while the boxing imparts sufficient rigidity to allow other frame and cladding components to be fastened to the studs by nailing.

Initial trials utilising structural members of the above described kind as wall studs have revealed a difficulty with stacking and transport. More conventional steel frame components of channel-like configuration, such as those used for top and bottom plates and noggings in steel house frames, are easily stackable for transport by nesting the components together. The edge formations of the box studs prevent nesting, however, and lateral ties or restraints are necessary on stacks to overcome the low coefficient of friction between opposed steel surfaces which otherwise prevents a stack of the studs from remaining stable. Stackability is also impaired by the thinness of the steel sheet in which the box studs are usually formed: advantageous in that the box studs are lightweight and cost efficient, but a disadvantage in that they are less robust in stacks.

It is an object of the present invention to overcome this difficulty.

SUMMARY OF THE INVENTION

The invention accordingly provides a structural member of the kind including a strip of metal sheet folded over onto itself at its lateral edges so that the member has respective boxed edge formations which extend between a pair of notional substantially parallel planes and are linked by a web between but offset from these planes, and wherein at least one and preferably both of the boxed edge formations defines a longitudinally extending ridge at one of said planes and, behind the other plane, an outwardly open longitudinally extending groove complementary to said ridge, whereby the structural member may be stacked on another similar member and the stack be laterally stabilised by co-operation of said groove on one member and said ridge on the other.

The web preferably defines, with opposed adjacent portions of the boxed edge formations, a longitudinally extending recess of generally dovetail cross-section.

The boxed edge formations are preferably of generally truncated triangular configuration in cross-section, defining a base containing the longitudinally extending groove and an apex forming the longitudinally extending ridge.

The edge formations preferably include parallel flat faces defining the lateral margins of the structural member.

The web is preferably substantially closer to said other notional plane than to said one plane.

The folded over portions of the metal strip preferably include an edge lip engaged against a centre portion of the metal strip, the lips and centre portion together defining the web. The lips are advantageously fastened to the centre portion, e.g. by spot welds, rivets or clinches.

BRIEF DESCRIPTION OF THE DRAWINGS

The invention Will now be further described, by way of example only, with reference to the accompanying drawings, in which.

EMBODIMENTS OF THE INVENTION

Figure 1:
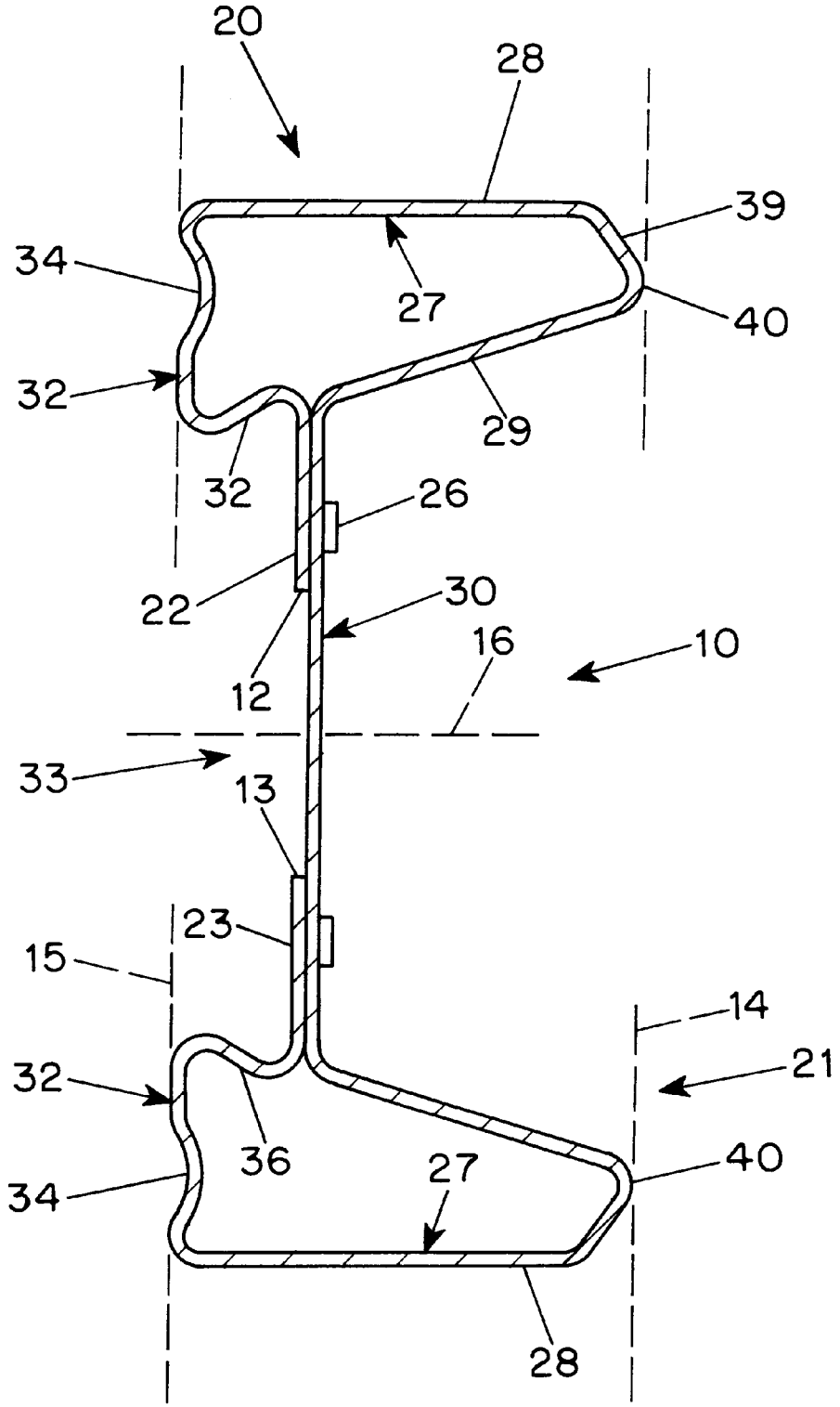
FIG. 1 depicts the uniform cross-section of an elongated structural member according to an embodiment of the invention, suitable for use as a wall stud component of a steel house frame.
Figure 2:
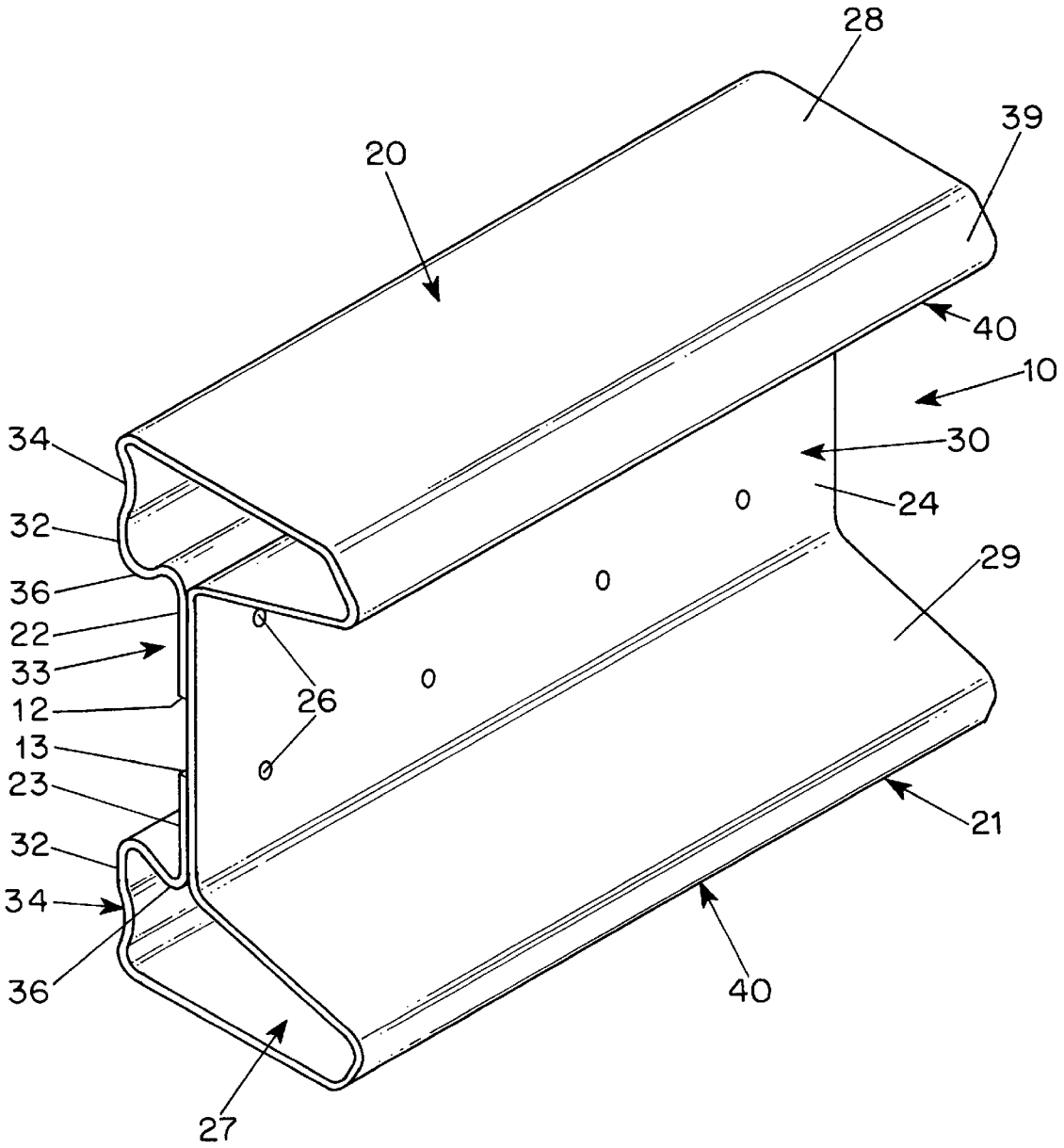
FIG. 2 is a sectioned isometric view of the structural member.

The structural member 10 illustrated in FIGS. 1 and 2 is typically rollformed from a strip of metal sheet, for example fiat steel coated with zinc or an alloy of aluminium and zinc, and is configured and dimensioned for use as a wall stud. It will therefore be hereinafter described as such. The gauge of the steel sheet is selected with regard to this application The strip is folded over onto itself at its lateral edges 12,13 so that the stud 10 has respective geometrically similar boxed edge formations 20, 21 which extend between a pair of notional substantially parallel planes 14, 15 and are linked by a web 30 between and parallel to but offset from these planes.

Web 30 is formed by the supposition of respective edge lips 22, 23, adjacent to lateral edges 12, 13, against a longitudinally extending flat centre portion 24 of the steel strip. It will be seen that the wall stud is wholly symmetrical about a centre plane 16 bisecting this centre portion 24 at 90° to the centre portion. Edge lips 22, 23 are fastened to centre portion 24 by respective lines of spaced fastenings 26, which may be e.g. spot welds, rivets or clinches.

Each of the geometrically similar boxed edge formations 20, 21 includes respective outer side segments 27 which define flat faces 28. Faces 28 are parallel, extend at right angles to the plane of web 30, and define the lateral margins of the stud. The boxed formations are generally of truncated right-triangular cross-section in which one of the rectangular sides is the outer segment 27 and the other is a base 32. Base 32 is generally in plane 15 but has a longitudinally extending shallow groove 34 of symmetrical concave cross-section. The inner margins of bases 32 are linked to edge lips 22, 23 by respective S- section portions 36 so that the web 30 and S-section portions 36 together define a broad groove 33 with a laterally restricted mouth, i.e. of generally dovetail cross-section. This recess facilitates engagement with other frame components and connecting elements, either within the recess or, alternatively, between one side of the recess 33 and the adjacent flat flange face 28, i.e. about the undercut wider end of the formations 20,21. One element which can be fixed in the latter manner is a b rick tic.

On the other side of web 30, the inside segment 29 of each boxed edge formation 20,21 tapers laterally outwardly away from the web and thus forms the hypotenuse of the aforementioned right-triangular cross-section. The outer end of the hypotenuse is truncated at 39 at an obtuse angle to outer face 28 so that the boxed formation defines a longitudinally extending ridge 40 as its extremity at notional plane 14. The tips of ridges 40 are offset inwardly from outer faces 28 and indeed are directly aligned with the centre lines of grooves 34 in a direction parallel to centre plane of symmetry 16 and outer faces 28.

Figure 3:
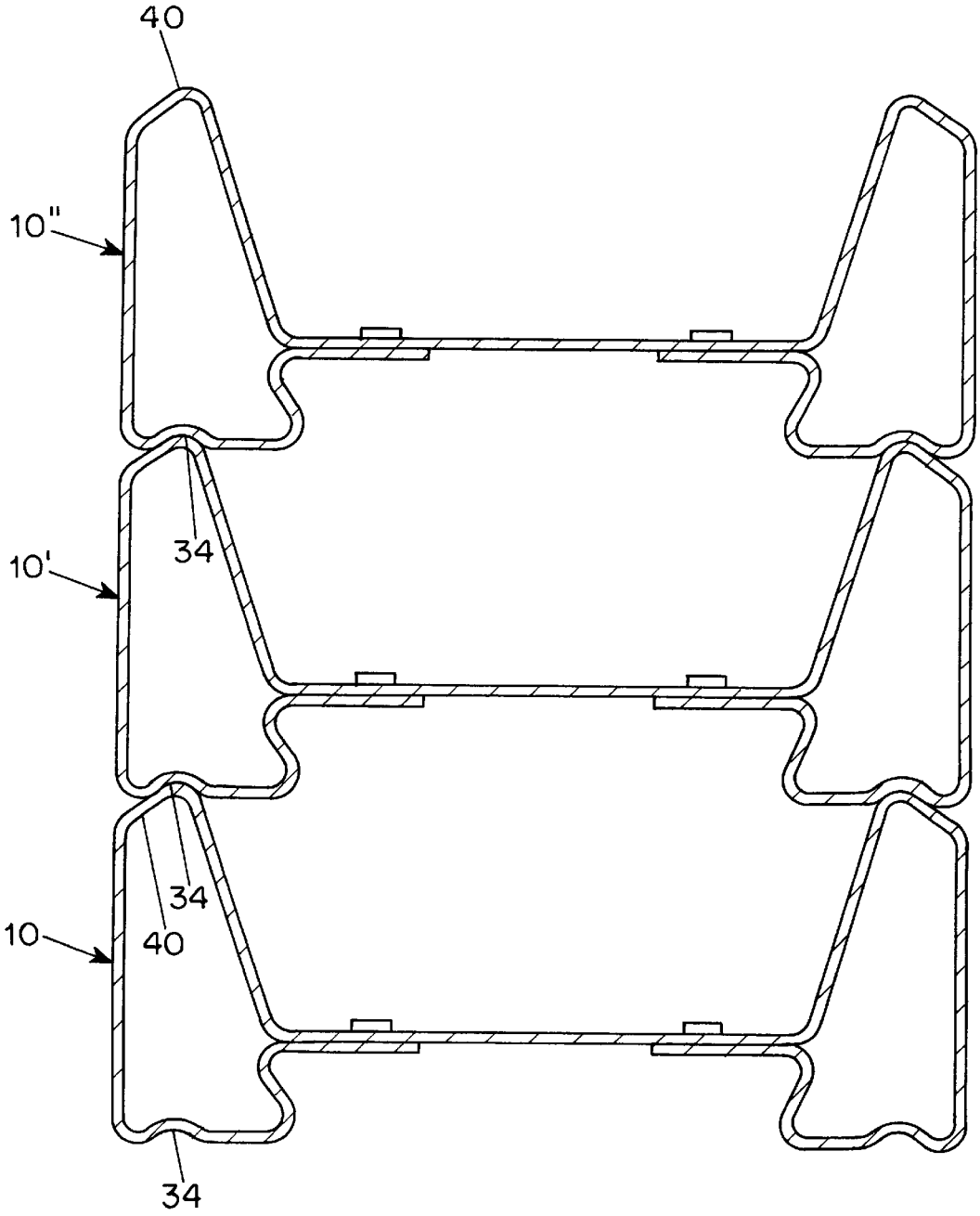
FIG. 3 depict s a three-member stack of the structural members.

FIG. 3 illustrates a stack of three of the studs 10, 10',10" for storage or transport. The stack is laterally stabilised by co-operation of grooves 34 of the overlying stud of each pair and the ridges 40 of the underlying stud. In particular, the grooves receive and centre the ridges and thereby discourage relative lateral movement between the studs which would otherwise easily occur given the lower co-efficient of friction between contacting steel surfaces, and which might other-wise give rise to damage to the relatively lightweight sheet from which the studs are formed. This is achieved without significantly altering the fundamental form of the structural member and without diminishing the qualities of strength and rigidity with minimum material which makes the member especially suitable as a wall stud, The, modification to achieve stacking stability, though functionally significant, requires only relatively small modification of the rollforming operation, Other forms of structural member to which the invention has application includes floor joists, ceiling joists, lightweight beams and the like.

It will be understood that the invention disclosed and defined herein extends to all alternative combinations of two or more of the individual features mentioned or evident from the text or drawings. All of these different combinations constitute various alternative aspects of the invention.

It will also be understood that the term "comprises" or its grammatical variants as used herein is equivalent to the term "includes" and is not to be taken as excluding the presence of other elements or features.

What is claimed is:

1. A structural member including a strip of metal sheet folded over onto itself at its lateral edges so that the member has two respective boxed edge formations, one along each lateral edge, both of which extend between first and second notional substantially parallel planes and are linked by a web, and wherein at least one of the boxed edge formations defines a longitudinally extending ridge at said first plane and, behind the second plane, an outwardly open longitudinally extending groove complementary to said ridge, whereby the structural member may be stacked on another similar member and the stack be laterally stabilized by co-operation of said groove on one member and said ridge on the other member.

2. A structural member according to claim 1 wherein both of the boxed edge formations define a said ridge and complementary groove.

3. A structural member according to claim 1 wherein said web is disposed between but offset from said notional planes.

4. A structural member according to claim 3 wherein said web defines, with opposed adjacent portions of the boxed edge formations, a longitudinally extending recess of generally dovetail cross-section.

5. A structural member according to claim 1 wherein said at least one boxed edge formation is of generally truncated triangular configuration in cross-section, defining a base containing the longitudinally extending groove and an apex forming the longitudinally extending ridge.

6. A structural member according to claim 1 wherein said boxed edge formations include parallel flat faces defining the lateral margins ofthe structural member.

7. A structural member according to claim 1 wherein said web is substantially closer to said second notional plane than to said first notional plane.

8. A structural member according to claim 1, wherein said folded over portions of the metal strip include an edge lip engaged against a centre portion of the metal strip, the lips and centre portion together defining the web.

9. A structural member according to claim 8 wherein said lips are fastened to the centre portion.

10. A structural member according to claim 1, configured and dimensioned as a wall stud, or as a floor or ceiling joist.

* * * * *